United States Patent [19]

Verschuur

[11] 4,080,176

[45] Mar. 21, 1978

[54] PROCESS FOR THE BENEFICIATION OF SOLID FUEL

[75] Inventor: Eke Verschuur, Amsterdam, Netherlands

[73] Assignee: Shell Oil Company, Houston, Tex.

[21] Appl. No.: 739,666

[22] Filed: Nov. 8, 1976

[30] Foreign Application Priority Data

Nov. 24, 1975 Netherlands ..... 7513673

[51] Int. Cl.[2] ..... C10L 9/10

[52] U.S. Cl. ..... 44/1 R; 44/1 G

[58] Field of Search ..... 44/1 R, 1 G

[56] References Cited

U.S. PATENT DOCUMENTS

| | | | |
|---|---|---|---|
| 2,183,924 | 12/1939 | Schoch | 44/1 G |
| 3,640,016 | 2/1972 | Lee et al. | 44/1 R |

*Primary Examiner*—Carl F. Dees

[57] ABSTRACT

The invention relates to a process for the beneficiation of solid fuel, in which a heat treatment at elevated pressure is applied to an aqueous suspension of the solid fuel in a finely divided form in the presence of an additive which, under the prevailing conditions, causes water-insoluble sulphur compounds to be converted into soluble compounds, after which fuel and water are separated.

12 Claims, No Drawings

PROCESS FOR THE BENEFICIATION OF SOLID FUEL

BACKGROUND OF THE INVENTION

Numerous materials that can be used as solid fuel contain so much impurities that a beneficiation is required to make them suitable for use. Examples of such solid fuels are the various kinds of brown coal, such as sub-bituminous coal, lignite and unconsolidated brown coal, the various kinds of coal, as well as peat, wood, paper, bitumen or asphalt, etc. All these materials can often only be used as a fuel after a pretreatment.

In some cases the beneficiation aims at greatly reducing the water content of the material (brown coal, peat, wood, paper). In other cases it is in particular the ash content that is reduced in the beneficiation (brown coal, coal). Often the sulphur content has to be reduced as well (bitumen, asphalt, brown coal, coal).

It will be clear that beneficiation not only improves combustion properties, but also reduces the cost of subsequent transport of the fuel. That in some cases this may mean a considerable saving becomes clear when it is considered that for example, certain kinds of brown coal contain up to 70%w of — mainly chemically bound — water and up to 40%w of ash-forming constituents.

In the past, it was attempted to find means of removing either the ash, the water or the sulphur compounds. A universal and attractive process by means of which two or more of these components can be removed from the fuel simultaneously is not yet available; however, the present invention aims at providing such a process.

It has been proposed to remove sulphur compounds from coal by subjecting an aqueous suspension of coal particles at elevated temperature to a heat treatment in the presence of chemicals which cause the water-insoluble sulphur compounds from the coal to be converted into soluble compounds. However, a considerable drawback of this proposal is that the subsequent separation of the coal particles and the aqueous phase by mechanical means, such as a centrifugal filter, etc., is far from complete. It yields a moist mass of coal particles containing not less than about 30%w of water. This mass must then be de-watered thermally, the result being that the dissolved sulphur compounds present in this residual water find their way into the coal again.

An aim of the present invention is to obviate this drawback and to make the very expensive thermal dewatering step superfluous.

SUMMARY OF THE INVENTION

The primary purpose of the present invention is to conduct the thermal dewatering of brown coal under conditions such that desulphurization is also achieved.

In accordance with the above and other purposes of this invention there is practised a process for the beneficiation of solid fuel, in which a heat treatment at elevated pressure is applied to an aqueous suspension of the solid fuel in a finely divided form in the presence of an additive which, under the prevailing conditions, causes water-insoluble sulphur compounds to be converted into soluble compounds, after which fuel and water are separated, characterized in that this separation is carried out by forming in the suspension, under conditions of turbulence and in the presence of a hydrocarbon-based water-insoluble binder, agglomerates of fuel and binder and by separating the agglomerates formed from the aqueous phase.

DESCRIPTION OF PREFERRED EMBODIMENTS

According to the invention, the separation of fuel and water after the heat treatment, mentioned above, is carried out by forming in the suspension, under conditions of turbulence and in the presence of a hydrocarbon-based water-insoluble binder, agglomerates of fuel and binder and by separating the agglomerates formed from the aqueous phase.

Since the agglomerates thus obtained are water-repellent, a complete separation of water and fuel can be effected in a simple manner (for instance mechanically). An important additional advantage is, that in the process according to the invention the fuel is simultaneously de-ashed, because the fuel particles are incorporated into the agglomerates, whereas the ash particles are not, so that in the subsequent separation the fine ash particles are removed in the water phase and the agglomerates stay behind.

For the agglomeration of the fuel particles any water-insoluble binder may be used which contains hydrocarbons that wet the fuel particles and under turbulent conditions, depending on the conditions, make them ball up to form soft cohesive agglomerates or hard pills.

These agglomerates or pills are much easier to separate from the aqueous phase than the individual fuel particles, for instance by taking them up into a light hydrocarbon fraction and effecting phase separation, or by collecting them on a sieve.

Examples of suitable binders are naphtha, fuel oil, bitumen and toluene.

The heat treatment of the aqueous suspension of finely divided solid fuel is usually carried out at temperatures above 150° C and preferably above 250° C at a pressure that is higher than the vapor pressure of water at that temperature. This renders it unnecessary to provide the heat required for the evaporation of the water.

Preferably, the aqueous suspension comprises substantially particles that are smaller than 2 mm and at least 30 %w of free water. These particles are then small enough and the suspension is sufficiently diluted for a fair degree of beneficiation of the fuel to be effected within an acceptable time.

An eligible additive is in principle any substance or combination of substances by means of which free sulphur, organically bound sulphur and/or insoluble inorganic sulphur compounds can be taken into solution. Numerous substances are known which are more or less capable of producing this effect. An example is the combination iron compound/oxygen. Another example is sodium or calcium hydroxide.

The present invention is pre-eminently suitable for application in the beneficiation of brown coal. Brown coal contains a relatively large percentage of chemically bound water and often also ash-forming constituents and sulphur compounds. It is known that at a high temperature brown coal not only gives off chemically bound water, but also undergoes such a change that no complete re-absorption of water will take place. Consequently, in the heat treatment applied, chemically bound water is irreversibly expelled from the brown coal. This phenomenon is sometimes called carbonization. In addition to this carbonization the process according to the invention also effects a de-ashing and a desulphurization.

It is certainly possible in the process according to the invention to use a permanent binder for agglomerizing the solid fuel. This is necessary in particular when it is desired to transport and/or to use the agglomerated fuel as such. An advantage here is the simple transport of the agglomerates; a disadvantage may be that the price of the binder is higher than that of the solid fuel itself.

It will therefore in some cases be preferred, after separation of the aqueous phase and the agglomerates, to remove the binder from the agglomerates and to recycle it. This may, for instance, be done by heating the agglomerates in a fluidized bed to a temperature above the boiling point of the binder.

Under certain circumstances it will be preferred according to the invention to add at least part of the binder to the aqueous suspension before the heat treatment. The contact time between binder and fuel particles will thus be increased, which may accelerate the subsequent agglomeration. In addition, it permits the use of a binder containing sulphur, because the sulphur compounds will disappear from the binder during the heat treatment of the aqueous suspension. The use of a binder containing sulphur may mean a considerable saving.

The invention will be illustrated hereinafter by two examples.

EXAMPLE I 500 g brown coal in lumps was ground with 500 g water in a colloid mill to a homogeneous suspension. The 500 g brown coal comprised about 300 g water, 180 g coal free of ash and sulphur, 8 g ash, 8 g organic sulphur and 4 g pyritic sulphur. To the suspension obtained was added 66 g heavy fuel oil containing 6 g organic sulphur and 30 g calcium hydroxide. The mixture obtained was vigorously stirred in a high-pressure autoclave and heated to 300° C in one hour, the pressure increasing to about 100 atm.

Thereupon the mixture was cooled to 20° C to two hours. The gases in the autoclave, which were collected separately and analyzed, were found to consist substantially of $N_2$ and $CO_2$.

The liquid containing the solids was passed through a sieve with an aperture size of 0.5 mm. In the sieve hard globular agglomerates (pills) were left, which, after drying at 110° C, were found to contain 30 g water. From the dry pills 62 g liquid hydrocarbon were extracted containing 2 g organic sulphur. It is assumed that this is substantially heavy fuel oil.

Composition:

170 g coal free of ash and sulphur,
2 g ash,
2 g organic sulphur, and
1 g pyritic sulphur.

The calorific value of the ash- and sulphur-free coal was 27.2 MJ/kg before and 31.5MJ/kg after the treatment described hereinbefore. The percentage of bound and/or unbound oxygen of this coal dropped from 20% to 8% as a result of this treatment.

EXAMPLE II

To a suspension identical with that of example I were added 70 g of a light sulphur-free crude oil fraction and 60 g colloidal fine iron oxide powder. This mixture was warmed up to 300° C in one hour in a vigorously stirred autoclave and subsequently cooled down to 20° C. The pills formed were also sieved off and, after drying at 110° C. which caused a light hydrocarbon to be released, were found to contain 40 g water. The dry solids had the following composition:

172 g coal free of ash and sulphur,
4 g ash,
1 organic sulphur and
0.2 g pyritic sulphur.

The calorific value of the ash- and sulphur-free coal was 27.1 MJ/kg before and 29.9 MJ/kg after treatment. The oxygen content also dropped from 20% to 8%.

I claim as my invention;

1. A process for deashing and dehydrating coal and for producing substantially sulfur-free agglomerates from the coal and oil, both originally containing organic sulfur and the coal additionally containing pyritic sulfur, comprising forming an aqueous suspension of the coal in finely divided form with the oil and an alkali metal hydroxide or alkaline earth metal hydroxide, agitating and heating the suspension at a temperature of at least 150° C at a pressure higher than the vapor pressure of water at that temperature until agglomerates of the coal and oil are formed, and separating the agglomerates from the water, ash and sulfur.

2. The process of claim 1 including extracting the oil from the coal.

3. The process of claim 2 wherein the oil is recycled.

4. A process for deashing and dehydrating coal and for producing substantially sulfur-free agglomerates from the coal and oil, both originally containing organic sulfur and the coal additionally containing pyritic sulfur, comprising forming an aqueous suspension of the coal in finely divided form with oil and iron oxide powder, agitating and heating the suspension at a temperature of at least 150° C at a pressure higher than the vapor pressure of water at the temperature until agglomerates of coal and oil are formed, and separating the agglomerates from the water, ash and sulfur.

5. The process of claim 3 including extracting the oil from the coal.

6. The process of claim 5 where in the oil is recycled.

7. A process for deashing and dehydrating coal and for producing substantially sulfur-free agglomerates from oil and coal which originally contains pyritic sulfur, comprising forming an aqueous suspension of the coal in finely divided form with the oil and an alkali metal hydroxide or alkaline earth metal hydroxide, agitating and heating the suspension at a temperature of at least 150° C at a pressure higher than the vapor pressure of water at that temperature until agglomerates of the coal and oil are formed, and separating the agglomerates from the water, ash and sulfur.

8. The process of claim 7 including extracting the oil from the coal.

9. The process of claim 8 wherein the oil is recycled.

10. A process for deashing and dehydrating coal and for producing substantially sulfur-free agglomerates from oil and coal which originally contains pyritic sulfur, comprising forming an aqueous suspension of the coal in finely divided form with the oil and iron oxide powder, agitating and heating the suspension at a temperature of at least 150° C at a pressure higher than the vapor pressure of water at that temperature until agglomerates of the coal and oil are formed, and separating the agglomerates from the water, ash and sulfur.

11. The process of claim 10 including extracting the oil from the coal.

12. The process of claim 11 wherein the oil is recycled and added to other coal.

* * * * *